United States Patent [19]

Karakama et al.

[11] Patent Number: 5,046,400

[45] Date of Patent: Sep. 10, 1991

[54] CONTROL VALVE SYSTEM

[75] Inventors: Tadao Karakama; Naoki Ishizaki; Yosuke Oda, all of Kanagawa, Japan

[73] Assignee: Kabushiki Kaisha/Komatsu Seisakusho, Tokyo, Japan

[21] Appl. No.: 425,176

[22] PCT Filed: Feb. 28, 1989

[86] PCT No.: PCT/JP89/00204

§ 371 Date: Oct. 17, 1989

§ 102(e) Date: Oct. 17, 1989

[87] PCT Pub. No.: WO89/08197

PCT Pub. Date: Sep. 8, 1989

[30] Foreign Application Priority Data

Feb. 29, 1988 [JP] Japan ..... 63-44103

[51] Int. Cl.[5] ..... F15B 11/08; F15B 13/04

[52] U.S. Cl. ..... 91/462; 137/596.2

[58] Field of Search ..... 137/596.2, 596.14, 596.15, 137/596.16; 91/454, 462

[56] References Cited

U.S. PATENT DOCUMENTS

| | | | |
|---|---|---|---|
| 1,187,960 | 6/1916 | Austin, Jr. | 137/596.2 |
| 2,984,257 | 5/1961 | McCormick et al. . | |
| 3,010,479 | 12/1956 | Foley | 91/454 |
| 3,556,144 | 1/1971 | Bickers et al. | 137/596.15 |
| 3,838,710 | 10/1974 | Reip . . | |
| 4,353,289 | 10/1982 | Lonnemo | 91/461 X |
| 4,479,678 | 10/1984 | Sharp | 91/454 X |
| 4,480,527 | 11/1984 | Lonnemo . | |
| 4,611,528 | 9/1986 | Nanda et al. . | |
| 4,646,622 | 3/1987 | Ishizaki et al. | 91/446 |
| 4,711,267 | 12/1987 | Schwelm | 137/596.15 |
| 4,747,424 | 5/1988 | Chapman | 137/596.2 X |
| 4,753,157 | 6/1988 | Lonnemo et al. | 91/454 X |
| 4,794,951 | 1/1989 | Ryzner . | |
| 4,811,650 | 3/1989 | Lonnemo | 91/461 |
| 4,955,283 | 9/1990 | Hidaka et al. . | |
| 4,984,427 | 11/1991 | Kubomoto . | |

FOREIGN PATENT DOCUMENTS

| | | | |
|---|---|---|---|
| 2431804 | 3/1975 | Fed. Rep. of Germany . | |
| 2343183 | 3/1976 | France | 91/454 |
| 5419217 | 2/1979 | Japan . | |
| 5773202 | 5/1982 | Japan . | |
| 6043701 | 3/1985 | Japan . | |
| 6213803 | 2/1987 | Japan . | |

*Primary Examiner*—Edward K. Look
*Assistant Examiner*—John Ryznic
*Attorney, Agent, or Firm*—Ronald P. Kananen

[57] ABSTRACT

In a control valve system provided with a plurality of valves for controlling a hydraulic equipment such as hydraulic cylinders, there are employed a plurality of valves each of which does not interfere with each other in operation and requires a minimum mounting space in the system to enable the system to be a small-sized system having a construction easily adapted to control a plurality of hydraulic equipments. The control valve system comprises: a valve (10) assuming a rectangular parallelepiped form; a first (11) and a second (12) pump port passage formed in an upper portion of a valve housing of the valve (10) so as to be parallel to each other; a tank port passage (13) formed in a lower central portion of the valve housing; a first (14) and a second (15) port passage vertically formed in the valve housing so as to separately open into an upper surface of the valve housing to communicate with each of pressure chambers of the hydraulic equipment; and a plurality of valves (19, 20, 23, 24) inserted into a plurality of valve receiving bores formed in the valve housing so as to shut off desired ones of these port passages from the remaining port passages.

2 Claims, 4 Drawing Sheets

CONTROL VALVE SYSTEM

FIELD OF THE INVENTION

The present invention relates to a control valve system for supplying a pressure oil to hydraulic equipments such as hydraulic cylinders, hydraulic motors and the like to control the hydraulic equipment in operation.

DESCRIPTION OF THE PRIOR ART

Hitherto, it is known that, for example, as shown in FIG. 1, in a control valve system of this type that: a pressure oil discharged from a hydraulic pump 1 is supplied to a first chamber $3_1$ and a second chamber $3_2$ of a hydraulic equipment 3 through a first meter-in valve $2_1$ and a second meter-in valve $2_2$, respectively wherein the meter-in valves $2_1$, $2_2$ are two-way valves. The pressure oil which entered the first chamber $3_1$ and the second chamber $3_2$ is discharged into a tank 5 through a first meter-out valve $4_1$ and a second meter-out valve $4_2$, respectively, the meter-out valves $4_1$, $4_2$ being two-way valves. When both the first meter-in valve $2_1$ and the second meter-out valve $4_2$ are opened, the pressure oil supplied to the first chamber $3_1$ of the hydraulic equipment 3, while the pressure oil having entered the second chamber $3_2$ of the equipment 3 is discharged from the second chamber $3_2$ of the equipment 3 into the tank 5. When both of the second meter-in valve $2_2$ and the first meter-out valve $4_1$ are opened, the pressure oil is supplied to the second chamber $3_2$ of the hydraulic equipment 3, while the pressure oil having entered the first chamber $3_1$ of the hydraulic equipment 3 is discharged therefrom into the tank 5.

On the other hand, in a power shovel, at least six types of hydraulic equipment are employed comprising: a boom derricking cylinder, an arm hydraulic cylinder, a bucket hydraulic cylinder, a swing hydraulic motor, a left-hand traveling hydraulic motor and a right-hand traveling hydraulic motor, to which hydraulic equipment the pressure oil is supplied through four valves. As a result, the power shovel requires at least 24 valves in operation.

In the conventional control valve system described above, a valve housing 6 of the control valve system: requires four interior valves comprising the first meter-in valve $2_1$, the second meter-in valve $2_2$, the first meter-out valve $4_1$ and the second meter-out valve $4_2$, and forms therein two pump ports $7_1$, $7_2$, two tank ports $8_1$, $8_2$ and four additional ports $9_1$, $9_2$, $9_3$, $9_4$. Consequently, when the above control valve system is employed in the power shovel, for the valve housing 6 of the control valve system of the power shovel requires 24 valves, a plurality of the pump ports, a plurality of the tank ports and a plurality of additional ports, which causes the valve housing 6 to be to large. In addition, in the valve housing 6 of the control valve system, it is very cumbersome to form each of the above ports.

SUMMARY OF THE INVENTION

In view of such circumstances described above, the present invention was made. Consequently, it is an object of the present invention to provide a small-sized control valve system requiring a minimum mounting space thereof, in which system a plurality of valves are employed to control hydraulic equipment, for example such as an hydraulic cylinder, without the risk that the plurality of the valves will interfere with each other in operation.

It is another object of the present invention to provide a small-sized control valve system requiring a minimum mounting space thereof, in which system a plurality of control valves are employed to control each of a plurality of types of hydraulic equipment without and there is fear that the plurality of control valves will interfere with each other in operation.

According to a first embodiment of the present invention, the above objects of the present invention are accomplished by providing a control valve system comprising: a valve housing which is provided with a predetermined lateral width, a predetermined longitudinal width and a predetermined height, and which assumes a substantially rectangular parallelepiped form; a first and a second pump port passage, each so formed in the valve housing as to have the same height, as to be parallelly spaced apart from each other in the longitudinal width direction of the valve housing, to horizontally extend in the lateral width direction of the valve housing and to communicate with a hydraulic pump; a tank port passage so formed in the valve housing as to be disposed in a lower portion of the valve housing, as to be disposed in a central position of the longitudinal width of the valve housing, to horizontally extend in the lateral width direction of the valve housing and to communicate with a drain tank; a first and a second port passage so formed in the valve housing as not to be aligned with each other in either of the lateral width direction and the longitudinal width direction, to extend vertically to open into an upper surface of the valve housing and as to communicate with the hydraulic equipment; a first meter-in valve so inserted into first valve receiving bore as to selectively shut off the first pump port passage from the first port passage in operation, the first valve receiving bore being formed in an upper portion of the valve housing so as to open into a side surface of the valve housing perpendicular to the longitudinal width direction thereof, to horizontally extend in the longitudinal width direction to penetrate the first pump port passage and to communicate with the first port passage; a first meter-out valve so inserted into a second valve receiving bore as to selectively shut off the tank port passage from the second port passage, the second valve receiving bore being formed in a lower portion of the valve housing so as to open into the side surface of the valve housing perpendicular to the longitudinal width direction thereof, to horizontally extend in the longitudinal width direction to sequentially communicate with the second port passage and the tank port passage; a second meter-in valve so inserted into a third and valve receiving bore as to selectively shut off the second pump port passage from the second port passage in operation, the third valve receiving bore being formed in the upper portion of the valve housing so as to open into the other side surface of the valve housing perpendicular to the longitudinal width direction thereof, as to horizontally extend in the longitudinal width direction to penetrate the second pump port passage and as to communicate with the second port passage; and a second meter-out valve so inserted into a fourth valve receiving bore as to selectively shut off the tank port passage from the first port passage, the fourth valve receiving bore being formed in the lower portion of the valve housing so as to open into the other side surface of the valve housing perpendicular to the longitudinal width direction thereof, as to horizontally extend in the longitudinal width direction to sequentially communicate with the first port passage and the tank port passage.

According to a second embodiment of the present invention, the above objects of the present invention are accomplished by providing a control valve system for controlling the hydraulic equipment of the first embodiment, wherein the control valve system is constructed of a plurality of control valve units for controlling a plurality of hydraulic devices, the plurality of the control valve units being connected with each other in the lateral width direction of the valve housing of the control valve system.

The control valve system of the present invention of the first and the second embodiments has the following advantages:

In the control valve system of the present invention, each of the first meter-in valve, the first meter-out valve, the second meter-in valve and the second meter-out valve is so formed in the valve housing of the control valve system so to horizontally extend in the longitudinal width direction of the valve housing to open into one of the opposite side surfaces of the valve housing perpendicular to the longitudinal width direction thereof; and as not to be aligned with each other in either the height direction or the lateral width direction of the valve housing. As a result, it is possible for the control valve system of the present invention to mount each of the valves in the valve housing with a minimum mounting space thereof.

Consequently, even when a plurality of valves are mounted in the valve housing of the control valve system of the present invention, it is possible for the control valve system of the present invention to realize a small-sized control valve system, because each of the plurality of the valves only requires a minimum mounting space thereof.

In addition, in the control valve system of the present invention, since each of the first and the second pump port passage and the tank port passage is formed in the valve housing of the control valve system so as to horizontally extend in the lateral width direction of the valve housing, it is possible to sequentially mount each of the first and the second meter-in valve and the first and the second meter-out valve in the valve housing so as to be spaced apart from each other in the lateral width direction of the valve housing. As a result, it is not required for the valve housing of the control valve system of the present invention to additionally form the first and the second pump port passage and the tank port passage therein. In other words, it is required for the valve housing of the control valve system of the present invention to form only the required number of each of the first and the second port passages in the valve housing, which reduces machining steps of the valve housing during its manufacture.

The above objects, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Hereinbelow, an embodiment of the present invention will be described in detail with reference to the accompanying drawings (FIGS. 2 to 6).

Figure 1:
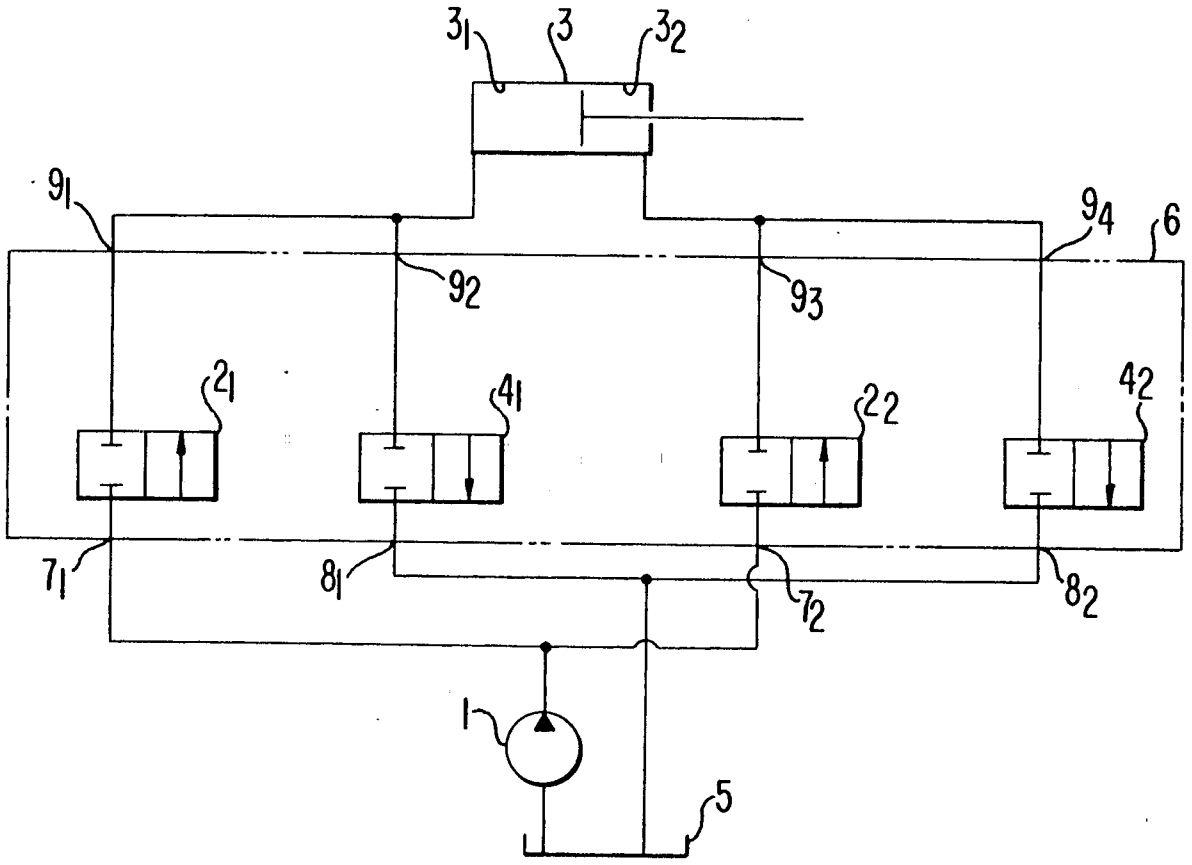
FIG. 1 (PRIOR ART)
FIG. 1 is a circuit diagram illustrating an example of a conventional control valve system.
Figure 2:
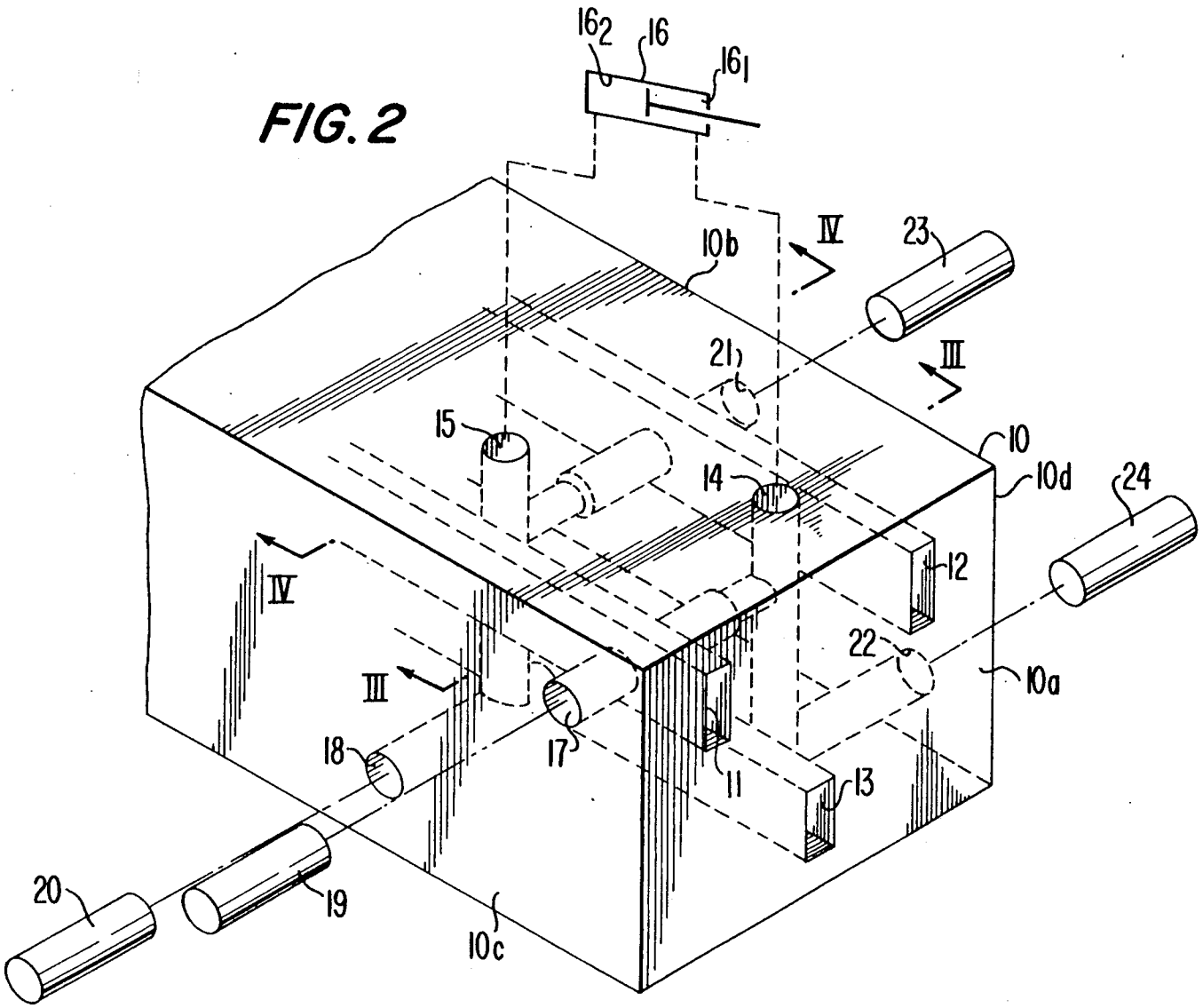
FIG. 2 is a perspective view of a valve housing of a control valve system of an embodiment of the present invention.
Figure 3:
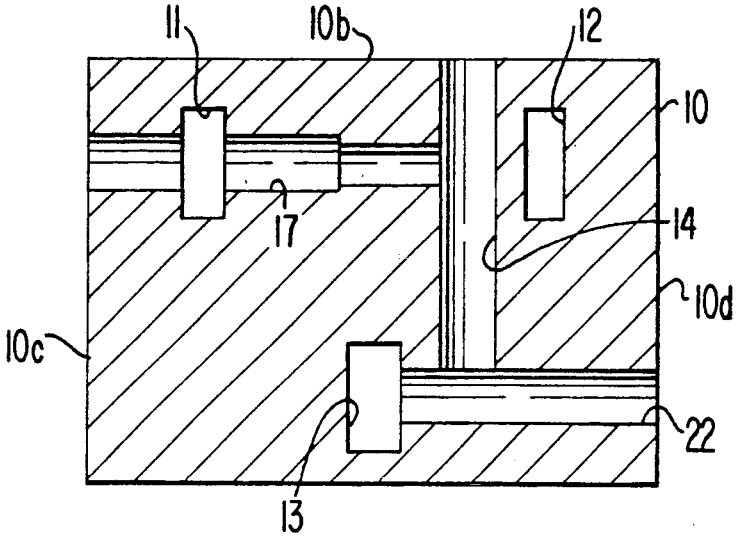
FIGS. 3 and 4 are cross-sectional views taken along the lines 111—111 and 1V—1V of FIG. 2, respectively.
Figure 4:
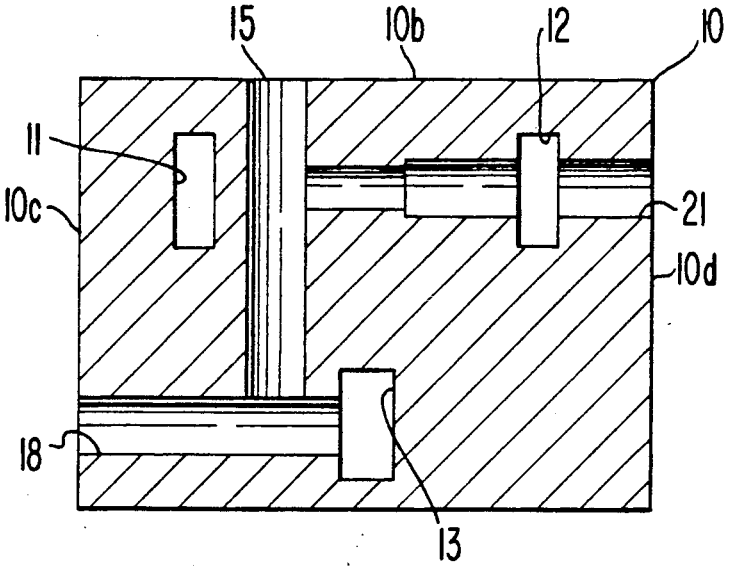

As shown in FIGS. 2 to 4, a valve housing 10 of a control valve system of the present invention has a predetermined lateral width, a predetermined longitudinal width and a predetermined height, and assumes a rectangular parallelepiped form. In an upper portion of the valve housing 10 of the control valve system are formed a first pump port passage 11 and a second pump port passage 12 which communicate with a hydraulic pump (not shown), are parallel to each other and horizontally extend in the lateral width direction of the valve housing 10 to open into an end surface 10*a* of the valve housing 10, which end surface 10*a* is perpendicular to the lateral width direction of the valve housing 10. In addition, a tank port passage 13 is so formed in the valve housing 10 as to be disposed in a lower portion of the valve housing 10, and in the central position of the longitudinal width of the valve housing 10, so as to horizontally extend in the lateral width direction of the valve housing 10 and to communicate with a drain tank (not shown) to open into the end surface 10*a* of the valve housing 10.

Further, a first port passage 14 and a second port passage 15 are formed in the valve housing 10 so as not to be aligned with each other in either the lateral width direction or the longitudinal width direction of the valve housing 10, so as to extend vertically to open into an upper surface 10*b* of the valve housing 10 and to communicate with a first pressure chamber $\mathbf{16}_1$ and a second pressure chamber $\mathbf{16}_2$ of a type of hydraulic equipment 16, respectively. In addition, the first port passage 14 and the second port passage 15 are formed in the valve housing 10 so as not to interfere with the first pump port passage 11, the second pump port passage 12 and/or the tank port passage 13.

Further, in the valve housing 10, a first meter-in valve receiving bore 17 and a first meter-out valve receiving bore 18 are formed so as to open into a side surface 10*c* of the valve housing 10 perpendicular to the longitudinal width direction of the valve housing 10, so as not to be aligned with each other in either the height direction or the lateral width direction of the valve housing 10, so as to horizontally extend in the longitudinal width direction of the valve housing 10. The first meter-in valve receiving bore 17 is disposed in the upper portion of the valve housing 10 so as to penetrate the first pump port passage 11, to communicate with the first port passage 14, and to receive a first meter-in valve 19 therein to selectively shut off the first pump port passage 11 from the first port passage 14. On the other hand, the first meter-out valve receiving bore 18 is disposed in the lower portion of the valve housing 10 so as to open into the tank port passage 13, to communicate with the second port passage 15 and to receive a first meter-out valve 20 therein to selectively shut off the tank port passage 13 from the second port passage 15.

Furthermore, in the valve housing 10, a second meter-in valve receiving bore 21 and a second meter-out valve receiving bore 22 are formed so as to open into the other side surface 10*d* of the valve housing 10 perpendicular to the longitudinal width direction of the valve housing 10, so as not to be aligned with each other in either the height direction or the lateral width direction of the valve housing 10, to horizontally extend in the longitudinal width direction of the valve housing 10. The second meter-in valve receiving bore 21 is disposed in the upper portion of the valve housing 10 so as to be aligned with the first meter-out valve receiving bore 18 in the lateral width direction of the valve housing 10, to penetrate the second pump port passage 12, to communicate with the second port passage 15, and to receive a second meter-in valve 23 therein to selectively shut off the second pump port passage 12 from the second port passage 15. On the other hand, the second meter-out valve receiving bore 22 is disposed in the lower portion of the valve housing 10 to be aligned with the first meter-in valve receiving bore 17 in the lateral width direction of the valve housing 10, as to open into the tank port passage 13, to communicate with the first port passage 14, and to receive a second meter-out valve 24 therein to selectively shut off the tank port passage 13 from the first port passage 14.

Figure 5:
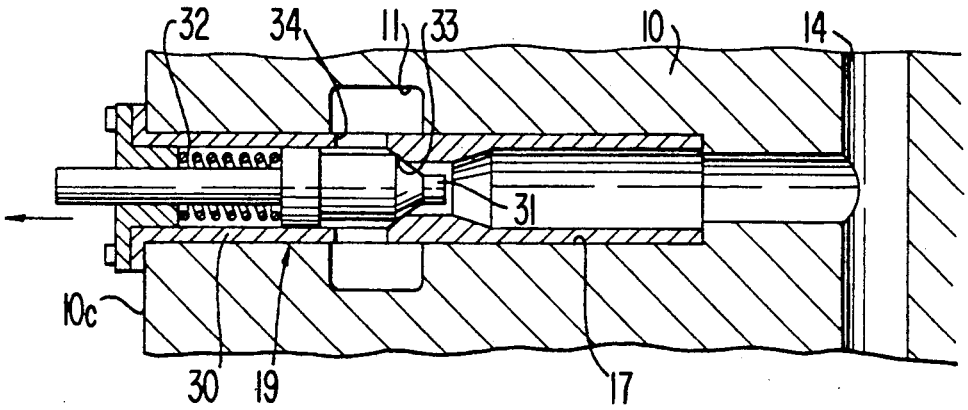
FIG. 5 is a longitudinal sectional view of the first meter-in valve of the control valve system of the present invention.

As shown in FIG. 5, in the first meter-in valve 19, a sleeve 30 is inserted into the first meter-in valve receiving bore 17 of the first meter-in valve 19, into which sleeve 30 is inserted a poppet 31 which is pressed against a valve seat 33 under the influence of a resilient force exerted by a compression spring 32 to shut off an inlet port 34 from the interior of the sleeve 30. When the poppet 31 is moved by means of a manually operated lever, or under the influence of hydraulic pressure, or by means of a solenoid in a direction indicated by an arrow shown in FIG. 5 against the resilient force exerted by the compression spring 32 to separate the poppet 31 from the valve seat 33, the inlet port 34 communicates with the interior of the sleeve 30 to enable the first pump port passage 11 to communicate with the first port passage 14.

The second meter-in valve 23 is similar in construction to the first meter-in valve 19 described above.

Figure 6:
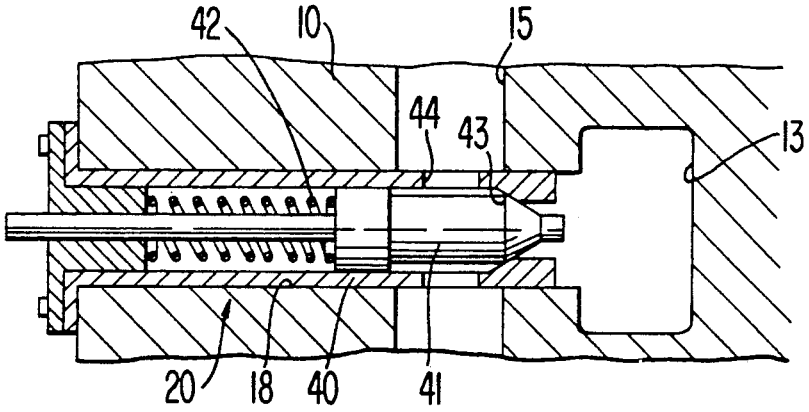
FIG. 6 is a longitudinal sectional view of the first meter-out valve of the control valve system of the present invention.

As shown in FIG. 6, in the first meter-out valve 20, a sleeve 40 is inserted into the first meter-out valve receiving bore 18 of the first meter-out valve 20, into which sleeve 40 is inserted a poppet 41 which is pressed against a valve seat 43 under the influence of a resilient force exerted by a compression spring 42 to shut off an inlet port 44 from the tank port passage 13. When the poppet 41 is moved by means of a manually operated lever, or under the influence of hydraulic pressure, or by means of a solenoid against the resilient force exerted by the compression spring 42 to separate the poppet 41 from the valve seat 43, the inlet port 44 communicates with the tank port passage 13.

The second meter-out valve 24 is similar in construction to the first meter-out valve 20 described above.

In addition, as disclosed in Japanese Patent Laid-Open No. 62-12758, each of the first meter-in valve 19, second meter-in valve 23, first meter-out valve 20 and the second meter-out valve 24 may be a flow control valve.

We claim:

1. A control valve system comprising: a valve housing which is provided with a predetermined lateral width, a predetermined longitudinal width, and a predetermined height, and assumes a substantially rectangular parallelepiped form; a first and a second pump port passage formed in said valve housing so that each has the same height, parallelly spaced apart from each other in said longitudinal width direction of said valve housing, to horizontally extend in said lateral width direction of said valve housing and to communicate with a hydraulic pump; a tank port passage so formed in said valve housing as to be disposed in a lower portion of said valve housing, and in a central position of said longitudinal width of said valve housing, to horizontally extend in said lateral width direction of said valve housing and to communicate with a drain tank; a first and a second port passage formed in said valve housing so as not to be aligned with each other in either said lateral width direction or said longitudinal width direction, to extend vertically to open into an upper surface of said valve housing and to communicate with hydraulic equipment; a first meter-in valve inserted into a first valve receiving bore so as to selectively shut off said first pump port passage from said first port passage in operation, said first valve receiving bore being formed in an upper portion of said valve housing so as to open into a side surface of said valve housing perpendicular to said longitudinal width direction thereof, so as to horizontally extend in said longitudinal width direction to penetrate said first pump port passage and as to communicate with said first port passage; a first meter-out valve inserted into a second valve receiving bore so as to selectively shut off said tank port passage from said second port passage, said second valve receiving bore being formed in a lower portion of said valve housing so as to open into said side surface of said valve housing perpendicular to said longitudinal width direction thereof, as to horizontally extend in said longitudinal width direction to sequentially communicate with said second port passage and said tank port passage; a second meter-in valve inserted into a third valve receiving bore so as to selectively shut off said second pump port passage from said second port passage in operation, said third valve receiving bore being formed in said upper portion of said valve housing so as to open into the other side surface of said valve housing perpendicular to said longitudinal width direction thereof, so as to horizontally extend in said longitudinal width direction to penetrate said second pump port passage and to communicate with said second port passage; and a second meter-out valve inserted into a fourth valve receiving bore so as to selectively shut off said tank port passage from said first port passage, said fourth valve receiving bore being formed in said lower portion of said valve housing so as to open into the other side surface of said valve housing perpendicular to said longitudinal width direction thereof, to horizontally extend in said longitudinal width direction to sequentially communicate with said first port passage and said tank port passage.

2. The control valve system as set forth in claim 1, wherein said control valve system is constructed of a plurality of control valve units for controlling a plurality of hydraulic devices, the plurality of said control valve units being connected with each other in said lateral width direction of said valve housing of said control valve system.

* * * * *